US012083588B2

(12) United States Patent
Flores Rosales

(10) Patent No.: US 12,083,588 B2
(45) Date of Patent: Sep. 10, 2024

(54) CASTING DEVICE FOR TILTING-POUR GRAVITY CASTING

(71) Applicant: Nemak, S.A.B. de C.V., Nuevo Leon (MX)

(72) Inventor: Alberto Flores Rosales, Nuevo Leon (MX)

(73) Assignee: Nemak, S.A.B. de C.V., Nuevo Leon (MX)

( * ) Notice: Subject to any disclaimer, the term of this patent is extended or adjusted under 35 U.S.C. 154(b) by 25 days.

(21) Appl. No.: 18/284,666

(22) PCT Filed: Mar. 24, 2022

(86) PCT No.: PCT/IB2022/052707
§ 371 (c)(1),
(2) Date: Sep. 28, 2023

(87) PCT Pub. No.: WO2022/208248
PCT Pub. Date: Oct. 6, 2022

(65) Prior Publication Data

US 2024/0082907 A1 Mar. 14, 2024

(30) Foreign Application Priority Data

Mar. 29, 2021 (EP) ..... 21165618

(51) Int. Cl.
*B22D 23/00* (2006.01)
*B22D 33/02* (2006.01)
*B22D 41/06* (2006.01)

(52) U.S. Cl.
CPC ..... *B22D 33/02* (2013.01); *B22D 23/006* (2013.01); *B22D 41/06* (2013.01)

(58) Field of Classification Search
CPC ..... B22D 23/006
(Continued)

(56) References Cited

U.S. PATENT DOCUMENTS 6,715,535 B2 4/2004 Kahn et al.
9,186,722 B2 11/2015 Morikawa et al.
(Continued)

FOREIGN PATENT DOCUMENTS

CN 102712041 A 10/2012
CN 105073304 A 11/2015
DE 20122596 U1 8/2006

*Primary Examiner* — Kevin E Yoon
(74) *Attorney, Agent, or Firm* — The Webb Law Firm

(57) ABSTRACT

The invention relates to a casting device for tilting-pour gravity casting, which includes a static frame, a rotatable frame adapted to be rotated with respect to said static frame over a horizontal axis. Said rotatable frame is adapted to hold a mold having a mold cavity and at least one inlet through which molten metal can flow into said mold cavity. A pouring container to contain molten metal having at least one pouring outlet through which said molten metal can flow by gravity from said pouring container to said mold inlet, and a holding arm attached to said second rotatable frame adapted to hold said pouring container so that the pouring container outlet is positioned in correspondence with said mold inlet with a pressing force over the mold as to avoid spills of molten metal out of said pouring container through the contact area of said pouring container and said mold. To enable a quick change of differently shaped casting molds with little effort, according to the invention the holding arm of such casting device includes an adjusting mechanism device for adjusting the position of the pouring container with respect to the position of said mold inlet in the direction of three space axes X, Y and Z with respect to said mold inlet.

10 Claims, 4 Drawing Sheets

(58) Field of Classification Search
USPC ..... 164/336
See application file for complete search history.

(56) References Cited

U.S. PATENT DOCUMENTS

| | | | | |
|---|---|---|---|---|
| 2002/0000304 | A1 | 1/2002 | Kahn et al. | |
| 2008/0289790 | A1* | 11/2008 | Greif ..... | B22D 23/006 164/121 |
| 2012/0325424 | A1 | 12/2012 | Morikawa et al. | |

* cited by examiner

CASTING DEVICE FOR TILTING-POUR GRAVITY CASTING

CROSS-REFERENCE TO RELATED APPLICATIONS

This application is the United States national phase of International Application No. PCT/162022/052707 filed Mar. 24, 2022, and claims priority to European Patent Application No. 21165618.6 filed Mar. 29, 2021, the disclosures of which are hereby incorporated by reference in their entireties.

BACKGROUND OF THE INVENTION

Field of the Invention

The present invention relates to the field of foundries and casting operations.

More particularly the invention refers to a casting device for tilting-pour gravity casting, also known in the industry as rotary casting, wherein a mold having a cavity with an in-gate inlet is filled with molten metal which is poured by gravity from a pouring container by positioning the pouring outlet of the pouring container with the in-gate inlet of the mold and thereafter the mold and the pouring container are together tilted up to a predetermined angle for allowing the molten metal to be poured from said pouring container into the mold and then the mold and the pouring container are tilted in reverse direction to continue with the casting cycle of the mold.

In exemplary embodiments of the invention, the casting device is adapted to the casting of aluminum automotive motor parts such as cylinder engine heads, with higher flexibility and efficiency than the currently used methods and equipment.

Tilting-pour casting is currently in practice in many foundries to produce high-quality castings, most of them designed for its assembly in the automotive industry, where a great proportion of these castings are made of aluminum alloys.

In some applications of the tilt-pour casting, the mold is rotated together with a pouring container having a pouring outlet which is placed correspondingly with one or more in-gate inlets of the mold so that when the mold together with the pouring container are tilted from a first position, where the pouring container is filled with molten metal and the mold is empty, up to a second position, where the molten metal has flown by gravity from the pouring container through the in-gate inlet or inlets of the mold and fills the casting cavity of said mold.

Description of Related Art

An example of this method tilt-pouring casting and a casting device to carry out the method is described in U.S. Pat. No. 6,715,535. This patent discloses a device for rotary casting comprising a mold mounted on a base plate, having an in-gate inlet pointing away from the upper face of the base plate. The base plate is rotatable around a horizontal rotational axis by at least 180° supported by bearings on a first static frame and driven by a suitable motor and drive to controllably rotate the base plate at an angular velocity such that the flow of molten metal into the mold is done smoothly and quiescently to avoid turbulence that might entail metal oxides with consequent defects in the castings.

The pouring container and the mold are sealingly coupled so that the molten metal does not spill outside of the mold. To this end, the outlet of the pouring container is designed to fit and seal with the mold in-gate geometry. The pouring container is attached to a holding arm fixed to the base plate and extends over the mold pressing the pouring container to the mold to achieve the seal by means of a hydraulic or pneumatic cylinder. To change molds having different geometries and dimensions the pouring container has to be attached to the holding arm at different positions in the three space directions X, Y and Z to fit precisely with each respective mold form and dimensions.

SUMMARY OF THE INVENTION

Against this technical background the object arose to provide a casting device for tilting-pour gravity casting in which differently shaped casting molds can be changed with little effort and in a time-saving manner.

The invention solved this object by providing a casting device with the features as described herein.

Advantageous embodiments of the invention are indicated in the dependent claims and are explained in detail below, as is the general idea of the invention.

A casting device for tilting-pour gravity casting comprising a first static frame and a second rotatable frame adapted to be rotated with respect to said first static frame over a horizontal axis. The second rotatable frame is adapted to hold a mold having a mold cavity and at least one inlet through which molten metal can flow into said mold cavity. The casting device also comprises a pouring container to contain molten metal having at least one pouring outlet through which said molten metal can flow by gravity from said pouring container to the mold inlet and a movable holding arm attached to said second rotatable frame adapted to hold said pouring container so that the pouring container outlet is positioned in correspondence with said mold inlet with sufficient pressing force over the mold as to avoid spills of molten metal out of said pouring container through the contact area of said pouring container and said mold.

According to the invention the holding arm comprises a three position adjusting mechanism allowing to modify the position of the pouring container with respect to the position of said mold inlet in the direction of the three space axes X, Y and Z with respect to said mold inlet.

BRIEF DESCRIPTION OF THE DRAWINGS

The invention is explained in more detail below with reference to a drawing showing an embodiment of the invention. In the drawing

DESCRIPTION OF THE INVENTION

Figure 1:
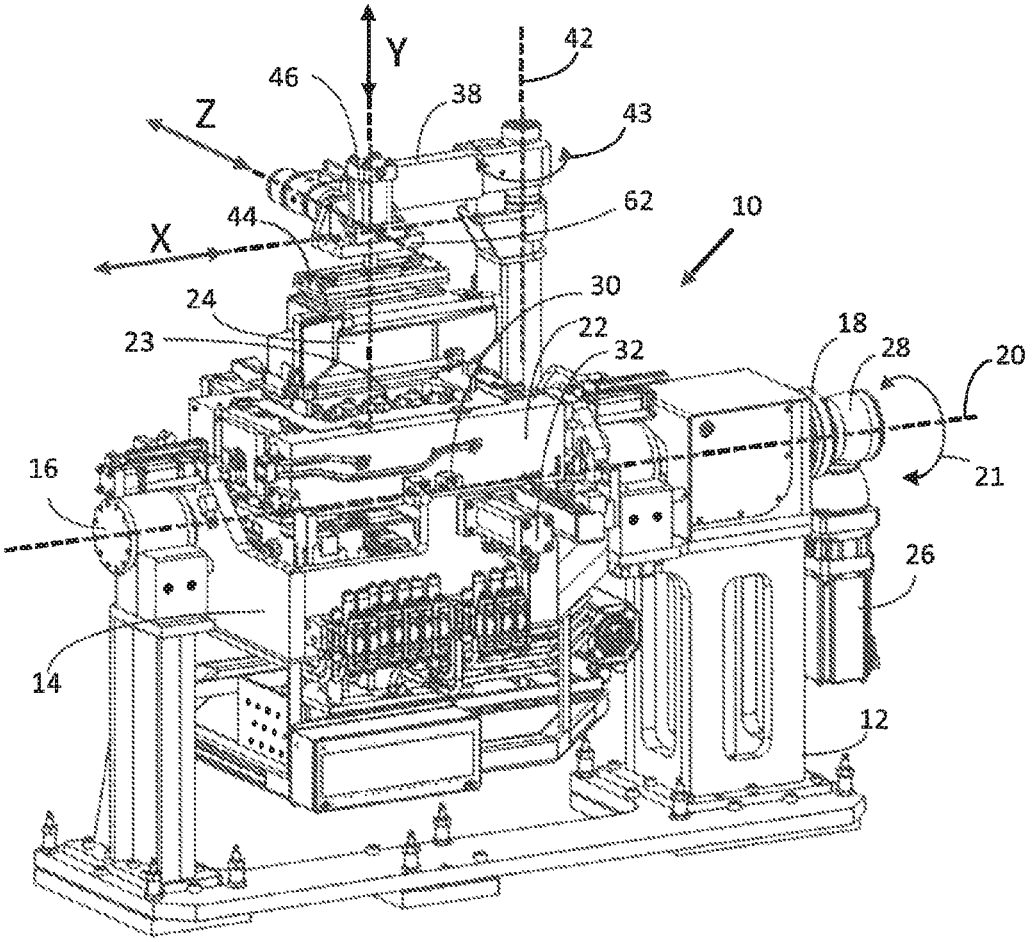
FIG. 1 is a diagrammatic front perspective view of a casting device according to the invention.
Figure 2:
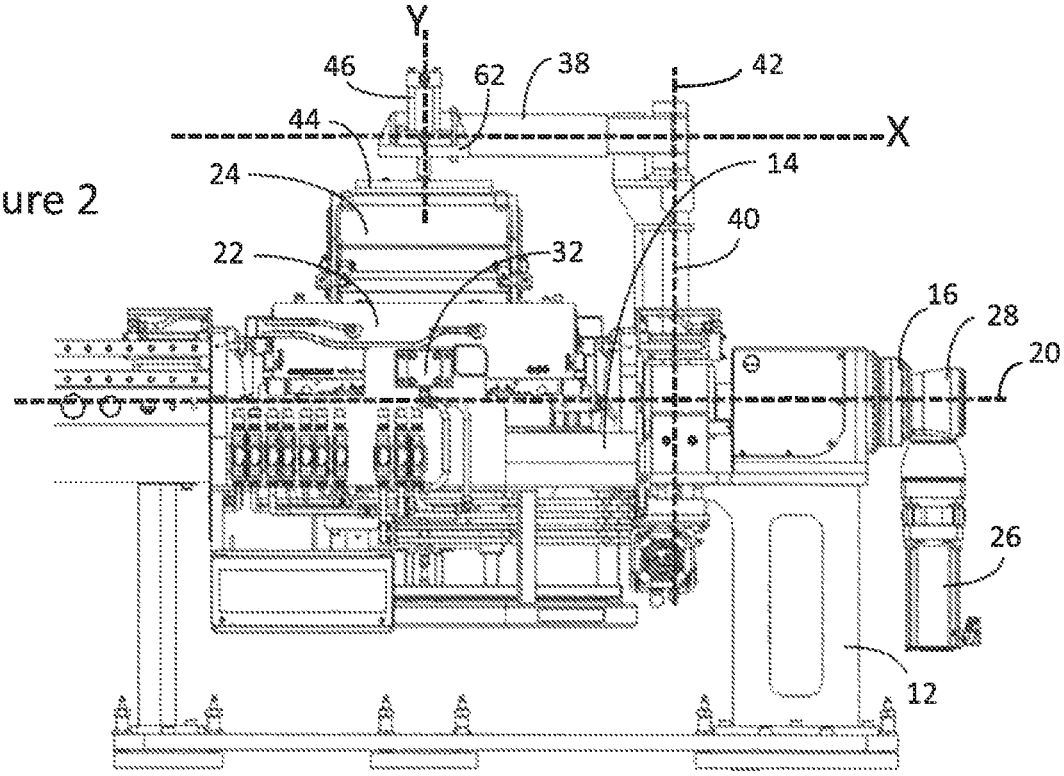
FIG. 2 is a diagrammatic front view of the casting device of FIG. 1.
Figure 3:
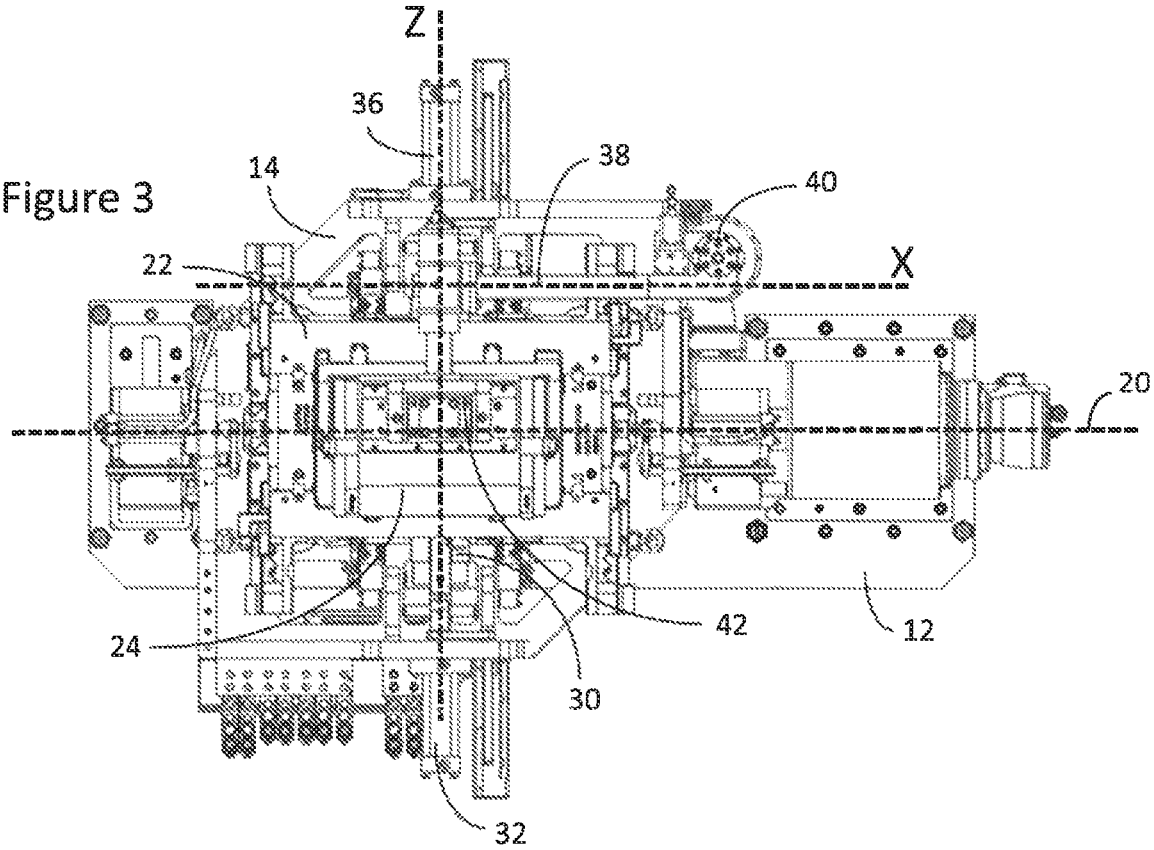
FIG. 3 is a diagrammatic plant view of the casting device of FIG. 1.

With reference to FIGS. 1, 2 and 3, numeral 10 generally designates an illustrative embodiment of a casting device according to the invention comprising a first static frame 12 and a second rotatable frame 14 which is supported by and suspended from said first static frame 12 by means of bearings 16 and 18 so that it can be rotated over a horizontal axis 20.

A mold 22 is held in its place over the second rotatable frame 14 by means of holders 30 which press said mold 22 by means of hydraulic or a pneumatic cylinder 32 and holders and a respective hydraulic or pneumatic cylinder 36. The mold may be of any type suitable for casting the desired products. For example the mold may be a permanent mold or die, or a partial permanent mold with sand cores or a sand core package mold.

The casting process comprises a first step of preparing the mold 22 by cleaning and placing the necessary cores setting it ready with the in-gates through which the molten metal will be poured facing upwardly and the pouring container 24 is placed empty over mold 22, and a second casting step when the second rotatable frame 14 rotates around axis 20 up to an angle where the pouring container 24 faces upward and can be filled with molten metal by means of a ladle. In some exemplary embodiments, this angle of rotation around axis 20 is 135°. Optionally, the ladle carrying the molten metal from a holding furnace to the pouring container is moved by means of a robot arm.

During the first step, the empty pouring container 24 is placed over the mold 22 by means of a rotary arm 38, extending horizontally and being supported by a vertical portion 40. The vertical portion or arm 38 can rotate around axis 42, as indicated by arrows 43, in order to move the pouring container 24 from a first position located away of the inlet or inlets of the mold 22 to a second position located over and in contact with the mold 22. In some exemplary embodiments, the angle of rotation around axis 42 is 180°.

The pouring container 24 is moved to the first position away of the mold 22 during the preparation step of the mold 22 and to the second position in contact with mold 22 during the time when the mold 22 is filled with molten metal. The pouring container 24 is attached to the arm 38 by means of a suitable fixed plate 44 and proper attachment means for example bolts or any type of fasteners that provide the necessary support.

After the mold 22 is prepared and ready to be filled with molten metal, the rotary arm 38 is rotated around the axis of rotation 42 to bring the pouring container 24 to its casting position over the mold 22. A hydraulic or pneumatic cylinder 46 is then activated to exert a downward force, pressing the pouring container 24 on the mold 22, in order to maintain the relative position of the pouring container over the mold 22 throughout the mold filling time of the casting cycle and to form a sealed contact in the contact area to avoid any spillage of molten metal while the mold 22 is being filled.

The cylinder 46 moves the pouring container 24 in the Y direction as indicated by a dotted line 47 in FIGS. 1, 2, 4 and 5.

The second rotatable frame 14 can be rotated over the horizontal axis 20, as indicated by arrows 21, an angle of at least 135° with respect to the first static frame 12. Rotating the second rotatable frame 14 this angle of rotation positions the pouring container 24 so that it can be filled with molten metal by means of a molten metal transfer ladle, not shown in the figures for simplicity of the disclosure, which is typically carried by a robot arm moving said transfer ladle from a position close to a molten metal holding furnace to the position where the molten metal can be poured into said pouring container 24 in a manner known in the art. The second rotatable frame 14 is rotated by means of a step motor 26 and a suitable driver 28.

When the geometry of the casting product changes and therefore the mold 22 has also to be changed, the setting time of the casting device 10 involves changing also some components thereof. In some instances, the mold 22 may have the position of the inlet or inlets for introduction of the molten metal at a different location on the upper surface of said mold 22. Also, perhaps the dimensions or geometry of the pouring container 24 may cause that the position of the inlet or inlets as compared with the previously utilized mold is different and therefore the position of the pouring container 24 has to be adjusted.

According to the invention, the casting device 10 is provided with mechanisms that allow the operator to adjust the position of the pouring container 24 with respect to the mold 22, in the three directions of the respective space axes X, Y and Z, mechanism 55 for adjustment in the direction of axis X, mechanism 47 for adjustment in the direction of axis Y and mechanism 49 in the direction of axis Z, so that its position is fixed with sufficient precision each casting cycle as to assure a reliable and repetitive operation with significant time saving to set the casting device 10 ready for continuing the production program. In some instances, this setting time is shortened by about 1.5 hours or more. The space axes X, Y, Z are aligned perpendicular.

The pouring container 24 is designed so that its volumetric capacity of molten metal can be adjusted by variations in its depth but substantially maintaining its dimensions of with and length which determine the points of contact of the pouring container with the mold. In this way, when the mold 22 requires a greater or smaller volume of molten metal, the respective pouring containers fit the same container holding elements attached to the arm 38.

Figure 4:
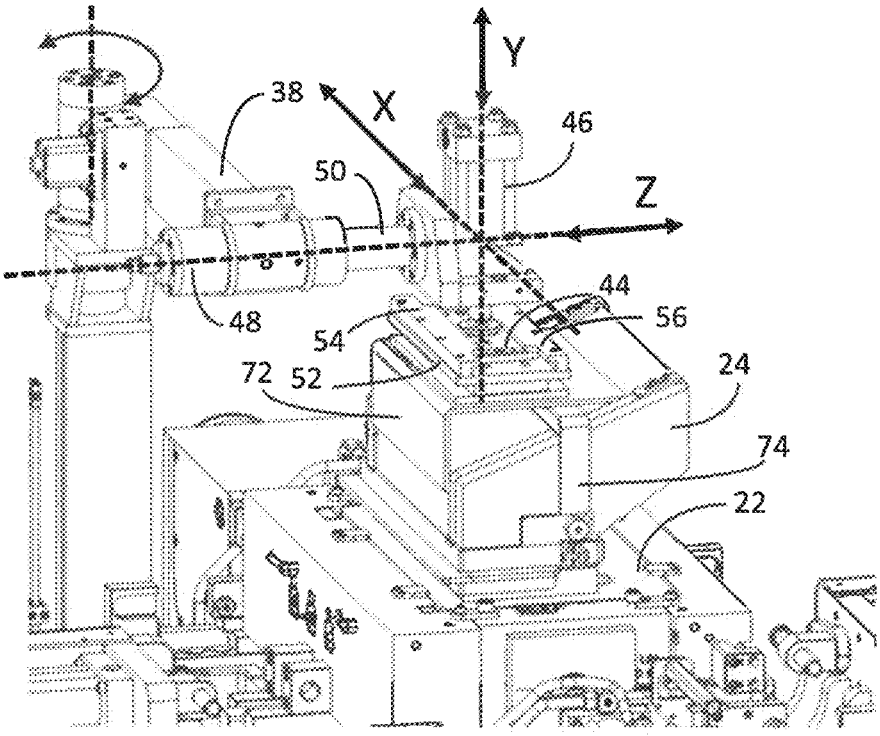
FIG. 4 is diagrammatic perspective view of the casting device of FIG. 1 showing in more detail an example of the mechanisms allowing adjustment of the position of the pouring container of such device in all three directions of space axes X, Y and Z, FIG. 5 a diagrammatic lateral view showing in more detail an example of the mechanism for positioning the pouring container in the direction of the Z axis.
Figure 5:
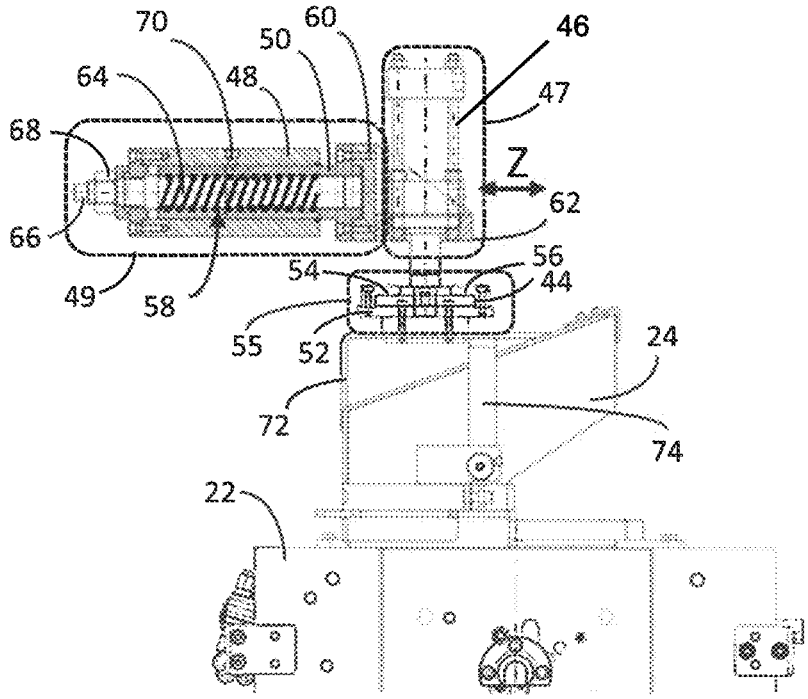
Figure 6:
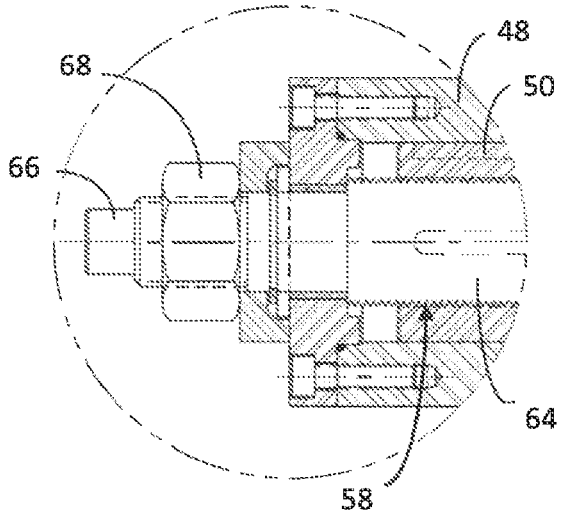
FIG. 6 is a diagrammatic partial cut view of the mechanism of FIG. 5.

With reference to an embodiment shown in FIGS. 4, 5, and 6, the adjustment of the position of the pouring container 24 in the direction of axis Y is made by means of a hydraulic or pneumatic cylinder 46 fixed to arm 38. Adjustment of the position of the pouring container 24 in the direction of axis Z is made by means of a sliding elongated element 50 which can be axially displaced inside a fixed tubular Element 48. Adjustment of the position of the pouring container 24 in the direction of axis X is made by means of a sliding movable plate 52 which can be displaced with respect to a fixed plate 44 from which it is sustained by two inverted L-shaped elements 54 and 56.

In some embodiments of the invention, as may be better seen in FIGS. 5 and 6, the mechanism for adjusting the position in the Z axis direction comprises a first fixed tubular element 48 attached to arm 38 and a second movable element 50 having an end 60 attached to a holding head 62 which holds the fixed plate 44 which in turn holds the pouring container 24.

The movable element 50 is threaded in its internal surface 58 and cooperates with a corresponding screw element 64 when it is rotated by an operator at the other end 66 to displace with precision the head 62 with respect to the mold 22. The final position of the head 62 is fixed in the desired position along the axis Z by means of nut 68. The movable element 50 is prevented from rotating over its longitudinal axis by means of at least one bolt 70 which extends internally within a groove formed on the external surface of the movable element 50 in the direction of the Z axis.

Figure 7:
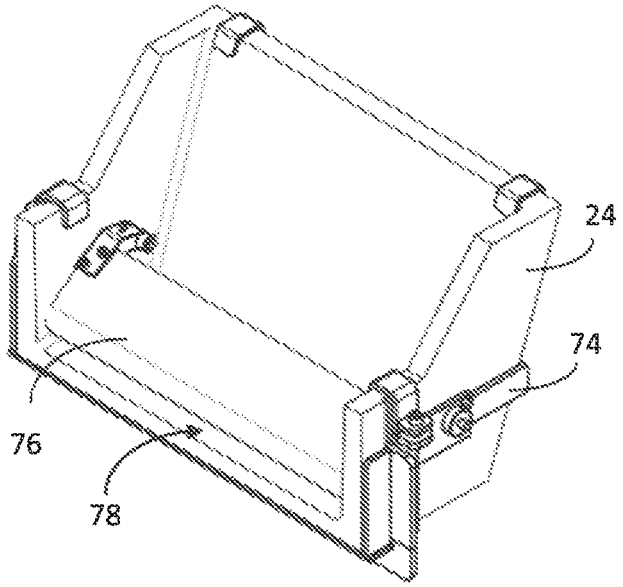
FIG. 7 is a diagrammatic perspective view of an example of a pouring container of the casting device of the invention.

With reference to FIGS. 4,5 and 7, in some embodiments of the invention, the pouring container 22 is attached to the movable holding 52 by means of a holding head 72 with hooks or holding elements 74 that firmly secure the pouring container 22. A deflector or baffle 76 is attached to the inner space of the pouring container 24 to allow regulation of the flow rate of the molten metal to the mold 22 by adjusting the height of the molten metal flow opening 78. This baffle helps to assure that the flow of the molten metal to the mold 22 is smooth and without turbulence so that no oxides are formed during the pouring of the molten metal into the mold by gravity as the second rotatable frame 14 rotates around axis 20.

The structure of the invention provides many advantages over the casting devices currently used in foundries, in terms of productivity since the setting time of the casting device is significantly shortened as much as 90 minutes.

It will be understood that the above description has been made for purposes of illustration as referred to the casting of aluminum engines heads, but that the invention can be used with advantages for other casting products. Also it will be understood that the mechanisms 47, 49 and 55, and other devices described herein to illustrate an embodiment of the invention can be substituted by other mechanisms that allow adjustments of the holding head of the pouring container with respect to the mold inlet or inlets by adjusting the position of said pouring container in the three directions of space axes X, Y and Z.

The invention thus provides a casting device for tilting-pour gravity casting comprising a first static frame and a second rotatable frame and a mold attached to said second rotatable frame along with a pouring container from which molten metal can flow by gravity from said pouring container to said mold. A holding arm attached to said second rotatable frame is adapted to hold said pouring container so that the pouring container outlet is positioned with respect to said mold inlet and with sufficient pressing force over the mold as to avoid spills of molten metal when said molten metal is poured from the pouring container to the mold inlet. The pouring container arm comprises position adjusting mechanisms allowing to modify and fix the position of the pouring container outlet in the three directions of space axes X, Y and Z relative to said mold so that the pouring container corresponds with the mold inlet when the geometry and dimensions of the mold are changed. The adjustment of the pouring container position in the directions of all three space axes X, Y and Z relative to said first static frame of said casting device allows for a shorter time of setting the casting device when the mold geometry and/or dimensions are changed.

The invention claimed is:

1. A casting device for tilting-pour gravity casting, comprising a first static frame, a second rotatable frame adapted to be rotated with respect to said first static frame over a horizontal axis wherein said rotatable frame is adapted to hold a mold having a mold cavity and at least one inlet through which molten metal can flow into said mold cavity, a pouring container to contain molten metal having at least one pouring outlet through which said molten metal can flow by gravity from said pouring container to said at least one mold inlet, and a moveable holding arm attached to said second rotatable frame adapted to hold said pouring container so that the at least one pouring container outlet is positioned in correspondence with said at least one mold inlet with a pressing force over the mold as to avoid spills of molten metal out of said pouring container through a contact area of said pouring container and said mold, wherein said movable holding arm comprises an adjusting mechanism device for adjusting the position of the pouring container with respect to the position of said mold inlet the direction of three space axes X, Y and Z with respect to said at least one mold inlet wherein the adjusting mechanism device comprises three individual adjusting mechanisms, the first adjusting mechanism being provided for moving the pouring container in the direction of the space axis X, the second adjusting mechanism being provided for moving the pouring container in the direction of the space axis Y, and the third adjusting mechanism provided for moving the pouring container in the direction of the space axis Z.

2. The casting device according to claim 1, where the space axes X, Y, Z are aligned perpendicular to each other.

3. The casting device according to claim 1, wherein said position adjusting mechanism provided to modify the position of the pouring container in the direction of said space axis X comprises a sliding movable plate which is slidably supported on a fixed plate.

4. The casting device according to claim 3, wherein the sliding movable plate is sustained by two inverted L-shaped elements on the fixed plate.

5. The casting device according to claim 1, wherein said position adjusting mechanism to modify the position of the pouring container in the direction of the axis Y is a hydraulic or a pneumatic cylinder.

6. The casting device according to claim 1, wherein said position adjusting mechanism to modify the position of the pouring container in the direction of the axis Z comprises a sliding elongated element which is arranged axially displacable inside a fixed tubular element.

7. The casting device according to claim 6, wherein said sliding elongated element threaded in its internal surface which cooperates with a corresponding screw element to displace the head holding the pouring container with respect to the inlet of said mold.

8. The casting device according to claim 1, wherein said pouring container comprises a baffle adapted to be positioned with respect to the outlet of said pouring container adjusting the molten metal flow opening.

9. The casting device according to claim 1, wherein said second rotatable frame is rotated around horizontal axis angle up to 135° with respect to said first static frame.

10. The casting device according to claim 1, wherein a swivel angle of said second rotatable arm around vertical axis is up to 180° with respect to said first static frame.

* * * * *